US012516669B2

(12) United States Patent
Dick et al.

(10) Patent No.: US 12,516,669 B2
(45) Date of Patent: Jan. 6, 2026

(54) ELECTRICAL AUTOMOTIVE LIQUID PUMP

(71) Applicant: PIERBURG PUMP TECHNOLOGY GMBH, Neuss (DE)

(72) Inventors: Georg Dick, Neuss (DE); Jacob Ruszczyk, Neuss (DE); Jerome Kremer, Inglange (FR); Monika Raja Thulasimani, Neuss (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 22 days.

(21) Appl. No.: 18/686,876

(22) PCT Filed: Aug. 30, 2021

(86) PCT No.: PCT/EP2021/073830
§ 371 (c)(1),
(2) Date: Feb. 27, 2024

(87) PCT Pub. No.: WO2023/030600
PCT Pub. Date: Mar. 9, 2023

(65) Prior Publication Data

US 2025/0129786 A1 Apr. 24, 2025

(51) Int. Cl.
*F04D 13/06* (2006.01)
*F04D 29/043* (2006.01)
*F04D 29/44* (2006.01)

(52) U.S. Cl.
CPC ..... *F04D 13/0633* (2013.01); *F04D 29/043* (2013.01); *F04D 29/448* (2013.01)

(58) Field of Classification Search
CPC .. F04D 13/0633; F04D 29/043; F04D 29/448; F04D 29/44; F04D 29/5813; F04D 13/0626; F05D 2240/61
See application file for complete search history.

(56) References Cited

U.S. PATENT DOCUMENTS 3,676,025 A * 7/1972 Shultz et al. ..... F04D 5/002 415/217.1
6,146,113 A * 11/2000 Fassnacht ..... H02K 5/207 417/367

(Continued)

FOREIGN PATENT DOCUMENTS

CA 2 848 130 A1 3/2013
CN 113137376 A 7/2021

(Continued)

OTHER PUBLICATIONS

English translation of FR-1218929-A (Year: 2025).*

*Primary Examiner* — Dominick L Plakkoottam
(74) *Attorney, Agent, or Firm* — Norman B. Thot

(57) ABSTRACT

An electrical automotive liquid pump includes a pump housing, a drive shaft which is co-rotatably connected to a pump wheel, an electrical drive motor having a motor rotor and a motor stator, and a separating tube which fluidically separates the motor rotor and the motor stator to define a wet zone and a dry zone within the pump housing. The motor rotor is co-rotatably connected to the drive shaft. The separating tube has an integral bearing seat structure which includes a bearing seat and a supporting structure. The supporting structure is defined by blades which connect the bearing seat with the separating tube. Each of the blades are arranged at a pitch angle with respect to a rotor axis so that a turbine-type shape is defined for the integral bearing seat structure. The bearing seat is provided with an integral plain bearing shell which directly supports the drive shaft.

16 Claims, 3 Drawing Sheets

(56) References Cited

U.S. PATENT DOCUMENTS

| | | | | |
|---|---|---|---|---|
| 8,979,504 | B2 * | 3/2015 | Snider | F04D 29/426<br>417/423.1 |
| 2008/0278026 | A1 * | 11/2008 | Kobayashi | H01R 39/22<br>310/253 |
| 2009/0010769 | A1 * | 1/2009 | Laufer | F04D 25/0606<br>417/420 |
| 2019/0368499 | A1 * | 12/2019 | Horler | F04D 29/058 |
| 2022/0178065 | A1 * | 6/2022 | Lee | D06F 37/269 |

FOREIGN PATENT DOCUMENTS

| | | | | |
|---|---|---|---|---|
| DE | 199 12 614 | A1 | | 9/2000 |
| FR | 1218929 | A | * | 5/1960 |
| GB | 903981 | A | | 8/1962 |

* cited by examiner

ELECTRICAL AUTOMOTIVE LIQUID PUMP

CROSS REFERENCE TO PRIOR APPLICATIONS

This application is a U.S. National Phase application under 35 U.S.C. § 371 of International Application No. PCT/EP2021/073830, filed on Aug. 30, 2021. The International Application was published in English on Mar. 9, 2023 as WO 2023/030600 A1 under PCT Article 21(2).

FIELD

The present invention is directed to an electrical automotive liquid pump for pumping a liquid within a liquid circuit of a vehicle, in particular for pumping oil or water within an auxiliary unit circuit.

BACKGROUND

An electrical automotive liquid pump according to the state-of-the-art is typically driven by a brushless electric motor which is electronically commutated by power electronic components. The power electronic components generate a relatively large heat quantity. The electric motor, in particular the motor stator, also generates an additional quantity of heat so that an effective heat dissipation within the pump housing is required. The electric motor is therefore designed as a canned electric motor, wherein the motor rotor and the motor stator of the electric motor are fluidically separated by a separating tube which is arranged within the gap between the motor rotor and the motor stator.

The fluidic separation of the motor rotor and the motor stator allows the volume at the inside of the separating tube to be flooded with the pumped liquid, which then defines a cooling flow for dissipating the heat which is generated by the electric motor and the power electronic components. The volume at the inside of the separating tube therefore defines a wet zone, and the motor rotor which is arranged within the wet zone and which rotates within the liquid is therefore a so-called wet running motor rotor. The motor stator and the power electronic components are not in contact with the pumped liquid due to the fluidic separation provided by the separating tube so that the volume of the pump housing outside of the separating tube defines a dry zone.

SUMMARY

An aspect of the present invention is to provide a simple and relatively cost-efficient electrical automotive liquid pump with an improved cooling flow behavior with respect to the prior art.

In an embodiment, the present invention provides an electrical automotive liquid pump which includes a pump housing, a pump wheel, a drive shaft which is co-rotatably connected to the pump wheel, an electrical drive motor comprising a motor rotor and a motor stator, and a separating tube which is configured to fluidically separate the motor rotor and the motor stator so as to define a wet zone and a dry zone within the pump housing. The motor rotor is co-rotatably connected to the drive shaft. The separating tube comprises an integral bearing seat structure which comprises a bearing seat and a supporting structure. The supporting structure is defined by a plurality of blades which connect the bearing seat with the separating tube. Each of the plurality of blades are arranged at a pitch angle with respect to a rotor axis so that a turbine-type shape is defined for the integral bearing seat structure. The bearing seat is provided with an integral plain bearing shell which directly supports the drive shaft.

BRIEF DESCRIPTION OF THE DRAWINGS

The present invention is described in greater detail below on the basis of embodiments and of the drawings in which.

DETAILED DESCRIPTION

Figure 1:
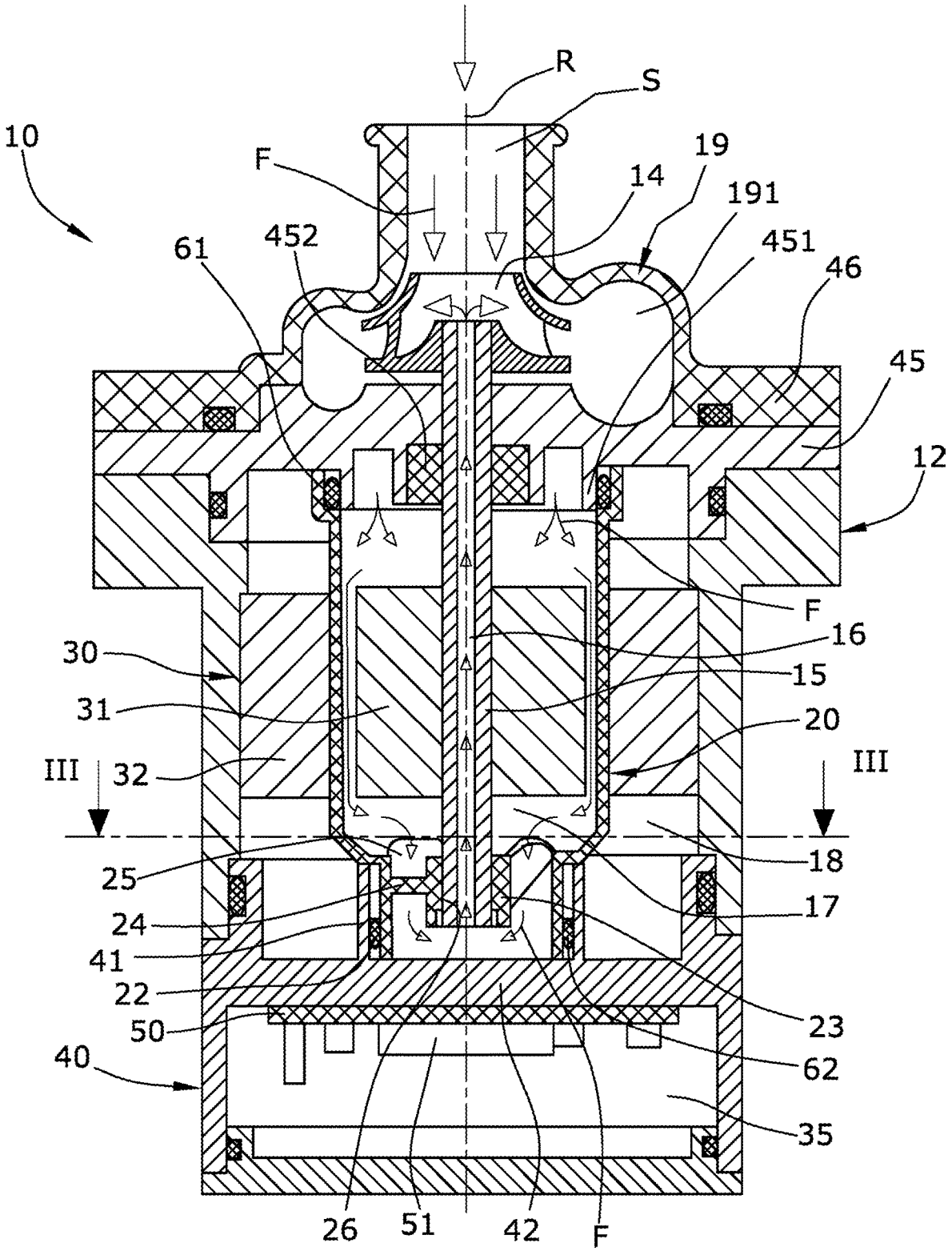
FIG. 1 shows a schematic longitudinal cross-sectional view of an electrical automotive liquid pump according to the present invention.

An electrical automotive liquid pump according to the present invention comprises an electric drive motor with a motor rotor and a motor stator, wherein the motor rotor is co-rotatably connected to a drive shaft which is co-rotatably connected to a pump wheel. The motor rotor accordingly rotates the pump wheel around a rotor axis for pumping the liquid within the electrical automotive liquid pump. The motor rotor and the motor stator are fluidically separated by a separating tube which can, for example, be arranged in the gap between the motor rotor and the motor stator. The separating tube thereby defines a wet zone and a dry zone within the pump housing, wherein the wet zone is flooded with liquid being pumped by the pump wheel.

The separating tube is provided with an integral bearing seat structure comprising a bearing seat and a supporting structure. The supporting structure is defined by several blades which connect the bearing seat with the separating tube, in particular with the tube-shaped sidewall of the separating tube which radially encloses the motor rotor. The blades of the supporting structure are arranged at a pitch angle with respect to the rotor axis which results in a turbine-type shaped bearing seat structure, wherein the blades can, for example, be arranged adjacent and equiangular to each other with a substantially identical pitch angle. The pitch angle substantially depends on the axial extension of the bearing seat structure and the number of the blades. The blades can, for example, not circumferentially overlap which allows for a relatively simple manufacturing of the separating tube, for example, via a molding process. An increasing number of blades results in a reduced pitch angle which is disadvantageous for a proper flow deflection.

The turbine-type shaped arrangement of the blades provides a forced axial and circumferential flow guidance of the liquid flowing through the wet zone. The liquid can, for example, branch off from a pumping section which is arranged at one axial end of the pump housing. From the pumping section in which the pump wheel rotates, the liquid flows through the wet zone towards the other axial end of the pump housing which is opposite to the pumping section. At that other axial end of the pump housing, the power electronic components can, for example, be arranged adjacent to a dry side of a separating wall which is part of a separate separating tube cover which can, for example, axially close the separating tube. The separating tube cover thereby fluidically separates the wet zone from a dry electronics chamber in which the power electronic components are arranged, for example, in a heat transferring contact to that side of the separating wall which is not in fluidic contact with the liquid.

Due to the rotation of the motor rotor, the liquid which flows through the wet zone is, in addition to its axial flow direction, rotated within the wet zone, thereby improving the convective heat transfer between the separating tube and the liquid flowing within the wet zone. The rotation of the motor rotor results in a domination of the circumferential flow component, however, so that the axial component of the flow becomes marginal. The blades of the turbine-type shaped bearing seat structure are accordingly arranged so that the rotating cooling flow is maintained within the bearing section of the separating tube where the bearing seat structure is arranged, however, the flow is redirected more into the axial direction so that the liquid is guided towards the separating wall and flows properly along the separating wall for absorbing the heat being transferred to the separating wall by the heat generating pump components.

Compared to a conventional bearing seat structure of a prior art pump with axially oriented ribs for connecting the bearing seat with the separating tube, the cooling flow profile of a pump with a bearing seat structure according to the present invention is much more uniform within the bearing section of the separating tube. The convective heat transfer, in particular at the separating wall which is loaded with the heat generated by the power electronic components, is therefore relatively large so that the heat dissipation within the bearing section is significantly increased compared to a prior art pump.

The bearing seat is also provided with an integral plain bearing shell to directly support the drive shaft within the bearing seat. The bearing seat accordingly does not need an additional separate bearing shell so that the direct support of the drive shaft within the bearing seat results in a relatively small required total radial space for the bearing seat. The turbine-type shaped supporting structure is therefore relatively large compared to a prior art pump with an additional separate bearing shell so that the blades are provided with a relatively large radial extension resulting in an exceptionally good guidance of the cooling flow.

In an embodiment of the present invention, the supporting structure can, for example, comprise at least three blades. The deflection of the flow from the substantially circumferential direction to the axial and circumferential direction can be provided sufficiently by using at least three blades. As the pitch angle of the blades depends on the axial length of the bearing seat structure and the number of the blades, a number of three or four blades represents a good compromise between a suitable pitch angle and a relatively short axial length of the bearing seat structure.

In an embodiment of the present invention, the bearing shell and the separating tube can, for example, be made of the same material. The separating tube and the bearing shell can, for example, be made of a plastic material with relatively good sliding properties, for example, the separating tube can be made of a Teflon®-based plastic material with a relatively small friction coefficient. A relatively low-friction support of the drive shaft is thereby provided.

In an embodiment of the present invention, the blades of the turbine type shaped bearing seat structure can, for example, be axially overhanging with respect to the bearing seat. The axial overhang is provided on that side of the supporting structure which faces the motor rotor, i.e., the blades axially extend over the axial end surface of the bearing seat. The overhang of the blades can, for example, be at least 5% of the axial blade length. The overhanging blade tips accordingly extend axially into that section where the cooling flow rotates around the rotor axis initiated by the rotating motor rotor. The cooling flow which rotates within the wet zone is as a result caught by the axially overhanging blade tips and is forcibly guided by the blades towards the separating wall. The axial overhanging blades are an independent aspect of the present invention and can be provided without an integral plain bearing shell which is a part of the bearing seat so that the axial overhang can alternatively be provided in an electrical automotive liquid pump, wherein the bearing seat is provided with a separate bearing shell.

In an embodiment of the present invention, the separating tube can, for example, be provided with a mounting section at one axial end, the mounting section having a smaller diameter than a diameter of the separating tube motor section defining that section where the motor rotor is arranged, i.e., that section which is arranged in the gap between the motor rotor and the motor stator. The mounting section can, for example, be arranged at that axial end of the separating tube where the bearing seat structure and the blades are arranged. The reduction of the diameter of the mounting section results in a reduced flow cross-section and therefore results in an acceleration of the cooling flow and thereby a relatively large convective heat transfer.

In an embodiment of the present invention, the mounting section can, for example, be provided with axial reinforcement ribs at its radial outside. As the separating tube can, for example, be inserted into a collar of the separating tube cover, the reinforcement ribs reinforce the mounting section and thereby reinforce that section where the bearing seat structure is arranged so that the deformation of the bearing seat structure or the sidewall of the mounting section is avoided. The drive shaft is thereby always exactly positioned without any deviation of the rotor axis. The axial reinforcement ribs are also used as a radial supporting structure for supporting and accurately positioning the mounting section within the separating tube cover's collar which can, for example, enclose the mounting section circumferentially.

In an embodiment of the present invention, the blades can, for example, extend radially over more than 50% of the radius of the mounting section. This results in a relatively large blade surface which contacts the cooling flow so that a relatively good cooling flow guidance and a relatively good deflection of the cooling flow towards the separating wall is provided.

In an embodiment of the present invention, the axial distance between the bearing seat structure and the separating tube cover can, for example, be at least 30% of the axial blade length. A blade-free section is thereby provided between the bearing seat structure and the heat loaded section of the separating wall so that a uniform and resistance-free rotational movement of the cooling flow within the blade-free section is provided, resulting in a proper convective heat transfer between the separating wall and the cooling flow.

The blades can, for example, be substantially planar which allows for a relatively simple manufacturing of the separating tube and which provides a sufficient flow deflection with only a slight not-useful cooling flow turbulence. The blades can alternatively also be provided with an arc-shaped cross section, as seen in a tangentially oriented cross plane, that could improve the flow deflection compared to the planar blade.

In an embodiment of the present invention, the blades can, for example, be provided with a profiled surface on that side of the blade which faces the motor rotor. For example, the blade surface facing the motor rotor could be provided with several substantially parallel flow guiding ribs which extend from the blade surface in an axial direction and which extend circumferentially along the blade surface. The flow guidance of the rotating cooling flow is therefore more laminar, resulting in a relatively good heat dissipation.

In an embodiment of the present invention, the cross-section of the blades can, for example, define an airfoil-shaped profile. The airfoil-shaped profile is arranged so that it is oriented, as seen in a tangentially oriented plane, towards the motor rotor. The liquid which is guided by the blades towards the separating tube cover flows along the airfoil-shaped blades so that the flow deflection towards the separating wall is improved compared to a planar or arc-shaped blade.

In an embodiment of the present invention, the pitch angle of the blades can, for example, be between 30° and 65° with respect to the rotor axis. The relation between the circumferential flow component and the axial flow component of the cooling flow is therefore relatively well-balanced resulting in a sufficient flow behavior at the separating wall.

An embodiment of the present invention is described below with reference to the enclosed drawings.

FIG. 1 shows an electrical automotive liquid pump 10 which is defined by an electrically driven centrifugal water circulating pump which is used for providing a relatively small cooling circuit of an auxiliary unit of a passenger car with water. The electrical automotive liquid pump 10 is provided with an electrical drive motor 30 comprising a cylindrical motor rotor 31 which is arranged at the radial inside of a hollow cylindrical separating tube 20 which is made of a Teflon®-based plastic material. A cylindrical motor stator 32 is arranged at the radial outside of the separating tube 20, the cylindrical motor stator 32 being arranged to circumferentially surround the separating tube 20 as well as the motor rotor 31. A hollow cylindrical separating tube motor section 202 is accordingly arranged in the air gap between the motor rotor 31 and the motor stator 32.

The separating tube 20 is at both of its axial ends closed by one component of a multipiece pump housing 12, wherein at its first axial end, the separating tube 20 is closed by a separating flange 45 which together with a pump cover 46 defines a pumping section 19 in which a pump wheel 14 rotates for pumping liquid through a volute 191. The separating flange 45 is therefore provided with an axially protruding separating flange collar 451 which is inserted into the separating tube 20, wherein a first sealing ring 61 is provided between the separating flange collar 451 and the separating tube 20. At the other opposite axial end of the separating tube 20 which is remote from the pump wheel 14, the separating tube 20 is closed by a separating tube cover 40 comprising a substantially planar separating wall 42 and an axially protruding separating tube cover collar 41 in which a cylindrical separating tube mounting section 201 is inserted. A second sealing ring 62 is provided between the separating tube cover collar 41 and the mounting section 201 for fluidically separating a wet zone 17 at the radial inside of the separating tube 20 from a dry zone 18 at the radial outside of the separating tube 20. At its radial outside, the mounting section 201 is provided with a plurality of equi-angularly arranged axial reinforcement ribs 28 for reinforcing the mounting section 201 and the bearing seat structure 22. The reinforcement ribs 28 avoid a deformation of the separating tube 20 and support the mounting section 201 of the separating tube 20 in the separating tube cover collar 41. The diameter d of the mounting section 201 is smaller than the diameter D of the separating tube motor section 202.

The motor rotor 31 is rotatably arranged within the wet zone 17, while the motor stator 32 is arranged within the dry zone 18. The motor rotor 31 is co-rotatably connected to a hollow-cylindrical drive shaft 15 which is provided with an axial backflow channel 16 which extends completely longitudinally through the drive shaft 15. The drive shaft 15 co-rotatably connects the motor rotor 31 with the pump wheel 14 which is thereby rotated around a rotational axis R for pumping the liquid from a suction port S to a discharge port (not shown). The drive shaft 15 is supported at the pumping-chamber-sided end of the separating tube 20 by a separate plain bearing 452 which is supported within the separating flange 45. At the other axial end of the separating tube 20 where the mounting section 201 is arranged, the drive shaft 15 is supported by an integral bearing seat structure 22 which is an integral part of the separating tube 20. This bearing seat structure 22 comprises a hollow-cylindrical bearing seat 23 with an integral plain bearing shell 26. The bearing seat structure 22 further comprises three blades 25 which define a supporting structure 24 which mechanically connects the bearing seat 23 with the radial sidewall of the separating tube 20. The bearing seat structure 22 and the integral plain bearing shell 26 are therefore made of the same Teflon®-based material as the separating tube 20.

The rotational motor rotor 31 defines a rotational direction RD. When the pump wheel 14 rotates, the liquid flows into the pumping section 19 through the suction port S, the liquid being axially sucked-in by the pump wheel 14. The liquid thereby defines a flow direction F. Due to the rotation of the pump wheel 14, the liquid is, as a result of the centrifugal force, discharged radially outwards so that the liquid enters the volute 191 of the pumping section 19, from where the liquid is pumped into the discharge port (not shown). The pumping section 19 is fluidically connected to the wet zone 17 by a borehole (not shown) which defines a connection channel through the separating flange 45 so that a relatively small volume flow of the pumped liquid is branched off from the total volume flow being pumped through the pumping section 19. This branched-off cooling flow F enters the wet zone 17 and flows axially towards the other axial end of the separating tube 20 towards a dry electronics chamber 35 which is fluidically separated from the wet zone 17 by the separating tube cover 40. A printed circuit board 50 is arranged within the electronics chamber 35, the printed circuit board 50 comprising several power electronic components 51 for electronically commutating and for driving the electrical drive motor 30.

As a result of the rotating motor rotor 31, the cooling flow F is rotated in the rotational direction RD by the motor rotor 31 so that the cooling liquid flows, in addition to its axial flow component, circumferentially at the radial inside of the separating tube motor section 202. The cooling flow F within the wet zone 17 accordingly absorbs the heat which is generated by the electrical drive motor 30, in particular the heat of the motor stator 32 which is transferred to the separating tube 20.

Figure 2:
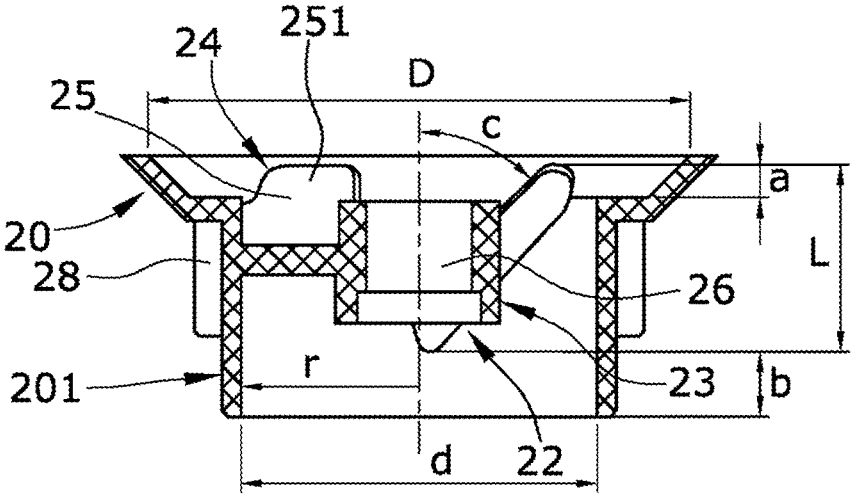
FIG. 2 shows a detailed cross-sectional view of the bearing seat structure of the electrical automotive liquid pump of FIG. 1.
Figure 3:
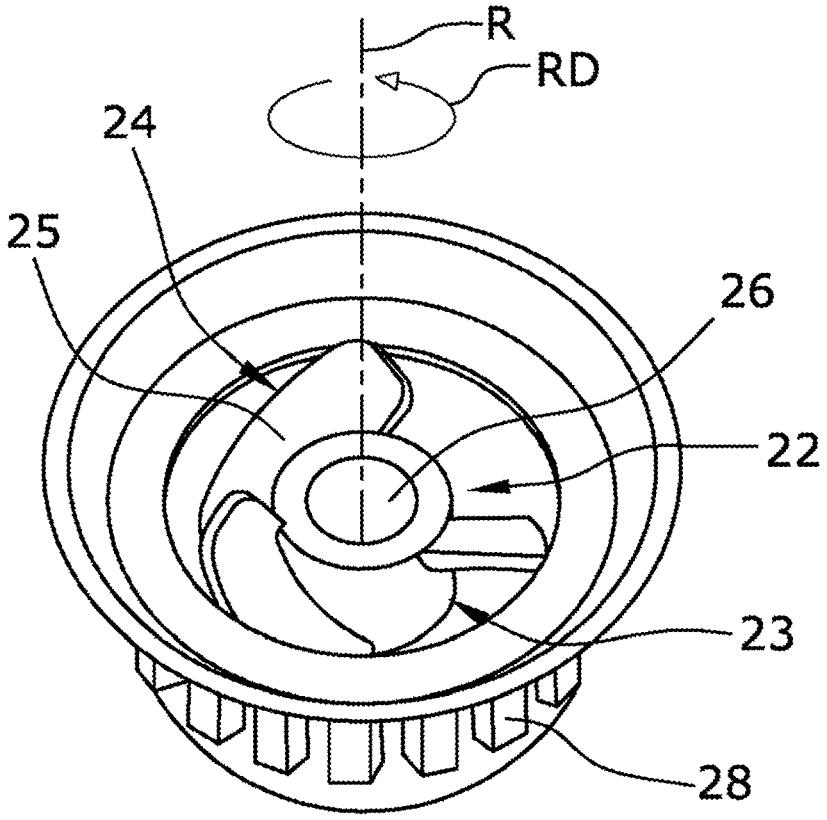
FIG. 3 shows a detailed perspective view of the bearing seat structure of the electrical automotive liquid pump of FIG. 1.
Figure 4:
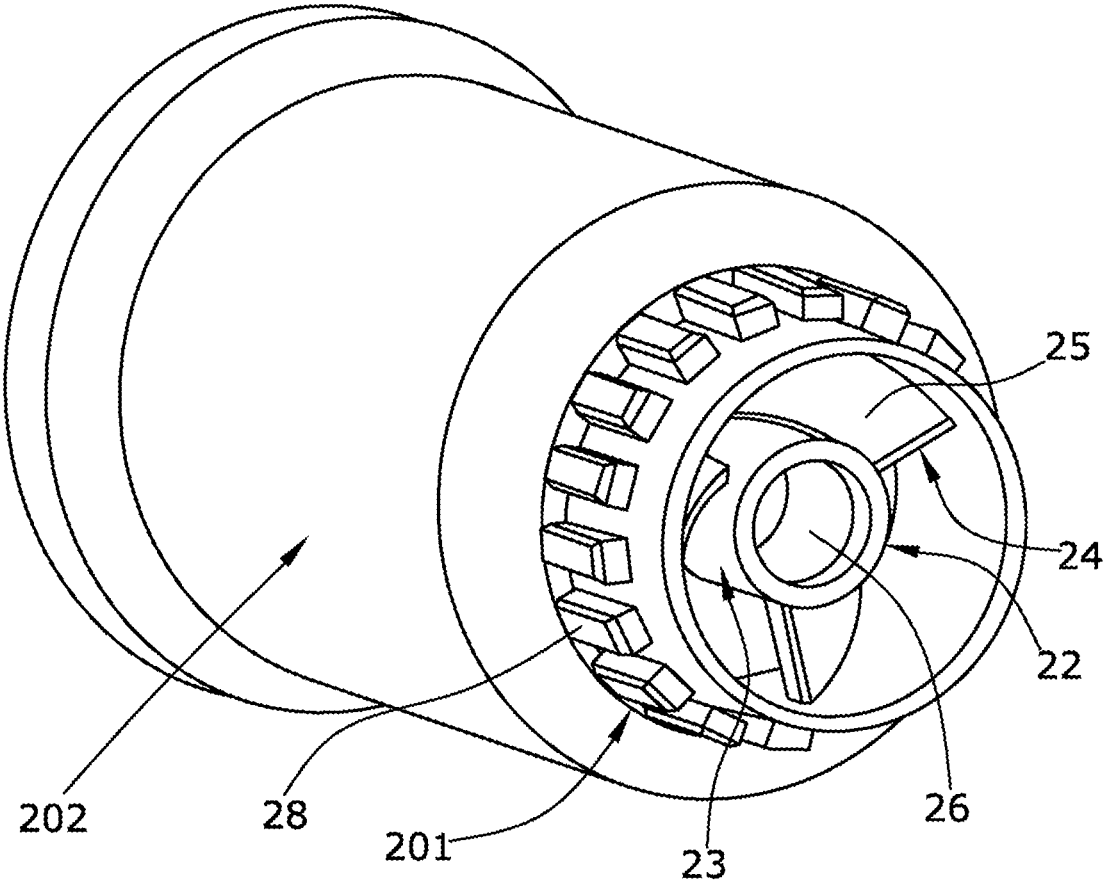
FIG. 4 shows a schematic perspective view of the separating tube of the electrical automotive liquid pump of FIG. 1.

The blades 25 of the bearing seat structure 22 are arranged at a pitch angle c with respect to the rotor axis R, as shown in FIGS. 2-4. The pitch angle c is 45°. The planar blades 25 are arranged with respect to the rotational direction RD of the motor rotor 31 so that the substantially circumferentially rotating cooling flow F is deflected more into the axial direction, whereby the circumferential flow component is not relevantly affected so that a vortex-type shaped cooling flow F is defined which flows through the bearing seat structure 22 vortically towards the separating wall 42 of the separating tube cover 40.

As shown in FIGS. 2 and 3, the blades 25 overhang axially with reference to the bearing seat 23. The axial overhang a which is provided at that side of the bearing seat structure 22 which faces the motor rotor 31 is 2.5 mm, wherein the axial blade length L of the blades 25 is 10 mm. The axially protruding blade tips 251 of the blades 25 extend axially into the circumferentially rotating cooling flow F between the motor rotor 31 and the bearing seat 23 and therefore catch the rotating cooling flow F to forcibly guide the cooling flow F through the bearing seat structure 22 towards the separating wall 42 of the separating tube cover 40.

As a result of the integral bearing shell 26, the bearing seat 23 is radially relatively small so that the radial extension of the blades 25 can be relatively large. The blades 25 radially extend over 55% of the radius r of the mounting section 201 so that the blades 25 allow for a sufficient cooling flow F to pass the supporting structure 24. The blades 25 also do not circumferentially overlap, as shown in FIG. 3, which allows for a simple manufacturing of the separating tube 20 using one simple molding process.

A blade-free section with an axial length b of 4 mm is provided between the bearing seat structure 22 and the separating wall 42 of the separating tube cover 40. The printed circuit board 50 is arranged next to the separating wall 42, wherein the printed circuit board 50 is arranged within the electronics chamber 35 in a heat transferring contact to the separating wall 42 at that side of the separating wall 42 which is not in a direct fluidic contact with the liquid within the wet zone 17. The vortically rotating cooling flow F therefore flows resistance-free along the separating wall 42 which results in a relatively uniform flow profile and provides a relatively good convective heat transfer between the separating wall 42 and the cooling flow F. This relatively good convective heat transfer allows for the absorbance of a relatively large heat quantity which is generated by the power electronic components 51.

As shown in FIG. 1, the heated liquid flows from the separating wall 42 back towards the pump wheel 14 through the axial backflow channel 16 of the drive shaft 15 and then returns to the pumping section 19 at the center of the pump wheel 14, where the heated cooling flow F mixes with cool liquid entering the pumping section 19 through the suction port S.

The present invention is not limited to embodiments described herein; reference should be had to the appended claims.

LIST OF REFERENCE CHARACTERS

10 Electrical automotive liquid pump
12 Pump housing
14 Pump wheel
15 Drive shaft
16 Axial backflow channel
17 Wet zone
18 Dry zone
19 Pumping section
20 Separating tube
22 Bearing seat structure
23 Bearing seat
24 Supporting structure
25 Blades
26 Integral plain bearing shell
28 Reinforcement ribs
30 Electrical drive motor
31 Motor rotor
32 Motor stator
35 Electronics chamber
40 Separating tube cover
41 Separating tube cover collar
42 Separating wall
45 Separating flange
46 Pump cover
50 Printed circuit board
51 Power electronic components
61 First sealing ring
62 Second sealing ring
191 Volute
201 Mounting section
202 Separating tube motor section
251 Blade tips
451 Separating flange collar
452 Separate plain bearing
a Axial overhang
b Axial length of blade-free section
c Pitch angle
d Diameter of the mounting section
D Diameter of the separating tube motor section
F Cooling flow
L Axial blade length
r Radius of the mounting section
R Rotational axis
RD Rotational direction
S Suction port

What is claimed is:

1. An electrical automotive liquid pump comprising:
a pump housing;
a pump wheel;
a drive shaft which is co-rotatably connected to the pump wheel;
an electrical drive motor comprising a motor rotor and a motor stator, the motor rotor being co-rotatably connected to the drive shaft; and
a separating tube which is configured to fluidically separate the motor rotor and the motor stator so as to define a wet zone and a dry zone within the pump housing, the separating tube comprising an integral bearing seat structure which comprises a bearing seat and a supporting structure,
wherein,
the supporting structure is defined by a plurality of blades which connect the bearing seat with the separating tube,
each of the plurality of blades is inclined at a pitch angle with respect to a rotor axis, and
the bearing seat is provided with an integral plain bearing shell which directly supports the drive shaft.

2. The electrical automotive liquid pump as recited in claim 1, wherein the plurality of blades of the supporting structure comprises at least three blades.

3. The electrical automotive liquid pump as recited in claim 1, wherein the integral plain bearing shell and the separating tube are both made of a same material.

4. The electrical automotive liquid pump as recited in claim 1, wherein,
the plurality of blades each have an axial overhang with respect to the bearing seat, and the axial overhang is provided on a side of the supporting structure which faces the motor rotor.

5. The electrical automotive liquid pump as recited in claim 4, wherein, the plurality of blades each have an axial blade length, and the axial overhang of the plurality of blades is at least 5% of the axial blade length.

6. The electrical automotive liquid pump as recited in claim 5, further comprising:

a separating tube motor section which is arranged in a gap between the motor rotor and the motor stator, wherein, the separating tube further comprises a mounting section at one end, the mounting section having a diameter which is smaller than a diameter of the separating tube motor section.

7. The electrical automotive liquid pump as recited in claim 6, wherein the mounting section comprises axial reinforcement ribs which are arranged at a radial outside of the mounting section.

8. The electrical automotive liquid pump as recited in claim 6, wherein the integral bearing seat structure is arranged within the mounting section.

9. The electrical automotive liquid pump as recited in claim 6, wherein, the mounting section has a radius, and the plurality of blades is arranged to extend radially over more than 50% of the radius of the mounting section.

10. The electrical automotive liquid pump as recited in claim 6, further comprising:

a separate separating tube cover which comprises a collar, wherein, the separating tube is, at an end which is remote from the pump wheel, closed by the separate separating tube cover, and the collar of the separate separating tube cover encloses the mounting section of the separating tube.

11. The electrical automotive liquid pump as recited in claim 10, wherein an axial distance between the integral bearing seat structure and the separate separating tube cover is at least 30% of the axial blade length.

12. The electrical automotive liquid pump as recited in claim 1, wherein the plurality of blades are arranged so as to not overlap circumferentially.

13. The electrical automotive liquid pump as recited in claim 1, wherein each of the plurality of blades are arranged to be substantially planar.

14. The electrical automotive liquid pump as recited in claim 1, wherein each of the plurality of blades are provided with a profiled surface on a side of the respective blade which faces the motor rotor.

15. The electrical automotive liquid pump as recited in claim 1, wherein a cross-section of the plurality of blades defines a shape that performs as an airfoil.

16. The electrical automotive liquid pump as recited in claim 1, wherein the pitch angle is between 30° and 65°.

* * * * *